United States Patent [19]

Yokoi

[11] 4,296,931

[45] Oct. 27, 1981

[54] PROJECTING-TYPE SHOOTING GAME APPARATUS

[75] Inventor: Gunpei Yokoi, Kyoto, Japan

[73] Assignee: Nintendo Co., Ltd., Kyoto, Japan

[21] Appl. No.: 23,780

[22] Filed: Mar. 26, 1979

[30] Foreign Application Priority Data

| | | | |
|---|---|---|---|
| Apr. 20, 1978 | [JP] | Japan | 53-047325 |
| Apr. 20, 1978 | [JP] | Japan | 53-047326 |
| Apr. 29, 1978 | [JP] | Japan | 53-051869 |
| Apr. 29, 1978 | [JP] | Japan | 53-059077[U] |

[51] Int. Cl.[3] ..... A63F 9/02

[52] U.S. Cl. ..... 273/316

[58] Field of Search ..... 273/101.1, 101.2, 316

[56] References Cited

U.S. PATENT DOCUMENTS

| | | | |
|---|---|---|---|
| 2,467,180 | 4/1949 | Andersen | 273/101.2 |
| 2,661,954 | 12/1953 | Koci | 273/101.2 |
| 3,326,552 | 6/1967 | Bilbao | 273/316 X |
| 4,090,712 | 5/1978 | Shields | 273/316 X |

FOREIGN PATENT DOCUMENTS

| | | | |
|---|---|---|---|
| 482171 | 12/1975 | U.S.S.R. | 273/101.2 |

*Primary Examiner*—Anton O. Oechsle

*Attorney, Agent, or Firm*—Koda and Androlia

[57] ABSTRACT

A projector type shooting game apparatus which provides a target movable on a screen under mechanical and manual control giving a player a feeling of real air fights. The apparatus includes a housing with some distance from a screen, a mirror rotatable in the horizontal and vertical direction in the housing, a mechanism for changing the vertical angle of the mirror, a mechanism for changing the horizontal angle of the mirror, a random driver for driving the above two means at a random direction, a lever for a player to rotate either in the horizontal or vertical direction, a coupling mechanism for connecting the lever's vertical rotation to the mechanism for changing the vertical angle of the mirror, and a coupling mechanism for connecting the lever's horizontal rotation to the mechanism for changing the horizontal angle of the mirror, wherein the motion of the target on the screen is effected by the random motion by the random driver and by the player's manual operation of the lever.

5 Claims, 16 Drawing Figures

PROJECTING-TYPE SHOOTING GAME APPARATUS

BACKGROUND OF THE INVENTION

1. Field of the Invention

This invention relates to a projector-type shooting game apparatus and more particularly to a projection type shooting game apparatus which has a moving target projected on a screen and a hit spot on the screen.

2. Prior Art

There has been known a projector-type shooting apparatus which has a hit spot on a screen such as U.S. Pat. No. 2,957,695; however, the track of a target is invariable. Therefore, timing is the only factor that determines if shooting was successful or not. In other words a player is expected to pay attention to only the shooting timing, which makes the game monotonous.

In addition to the above, it has been known to place a mirror between a target forming means comprising a light source, a target slit, and a lens and a screen, said mirror being rotatable in both horizontal and vertical direction, whereby the target projected on the screen can move in any direction on the screen by rotating the mirror. The above is disclosed in, for example, U.S. Pat. No. 3,904,204 which was invented by the same inventor as the present invention. This type of apparatus has a receiving type electron gun containing photoelectric elements to determine coincidence between a target and a shooting point and the timing, any point on the screen can be a hit spot.

In either way, the target on the screen moves under automatic mechanical control and the player has no control over the motion of the target by his manual operation.

SUMMARY

It is the primary object of this invention to provide a shooting game apparatus which projects a target (airplane, tank, etc.) irregularly moving on a screen under mechanical control, said target being also changing its motion by player's manual operation, wherein the player enjoys a feeling of operating an airplane (tank) chasing a target airplane (tank).

It is another object of this invention to provide a simple hit sensing means for detecting any effective shooting at a proper timing and a proper spot.

It is still another object of this invention to provide a hit sensing device which detects a hit upon firing a gun at a proper timing and effective hit spot.

In keeping with the principles of this invention, the above objects are achieved by a unique combination of elements including a housing having a longitudinal axis provided some distance from a screen, a mirror rotatable about mutually perpendicular axes in the housing, a means for rotating the mirror about one of the axes, a random driving means for driving the above two means at a random direction, a lever for a player to rotate about either of two mutually perpendicular axes, a means for connecting the lever's rotation about one axis to the means for rotating the mirror about the one axis, and a means for connecting the lever's rotation about the other axis about which it rotates to the means for rotating the mirror about the other axis about which it rotates, wherein the motion of the target on the screen is effected by the random motion by the random driving means and by the player's manual operation of the lever.

DETAILED DESCRIPTION OF THE INVENTION

Figure 1:
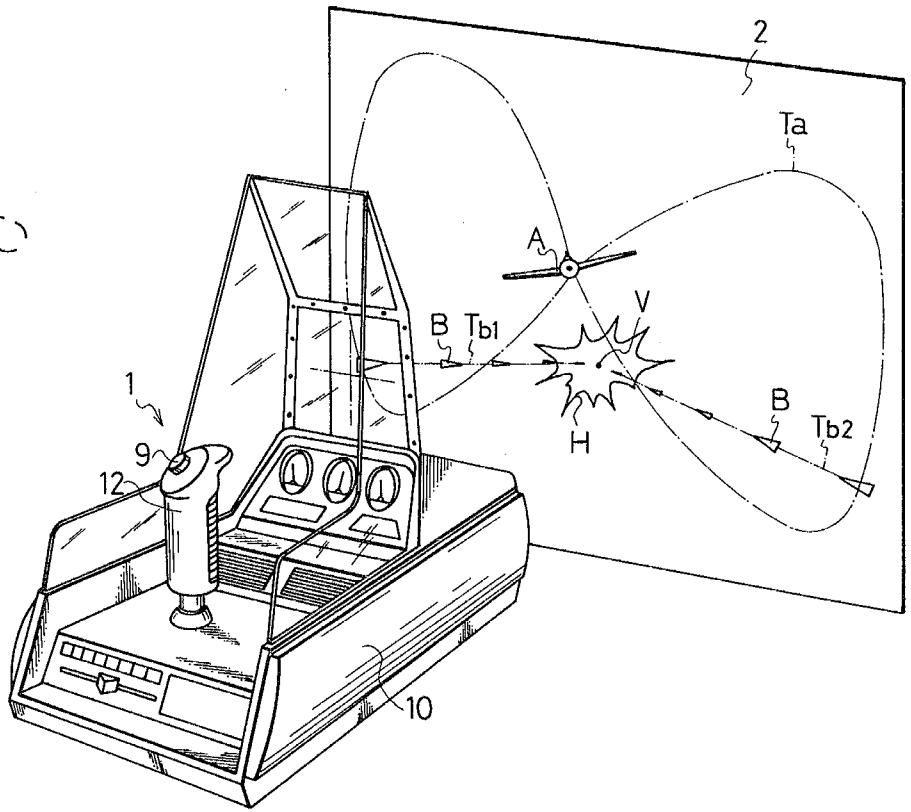
FIG. 1 shows a perspective view of an embodiment of the shooting game apparatus of this invention.
Figure 2:
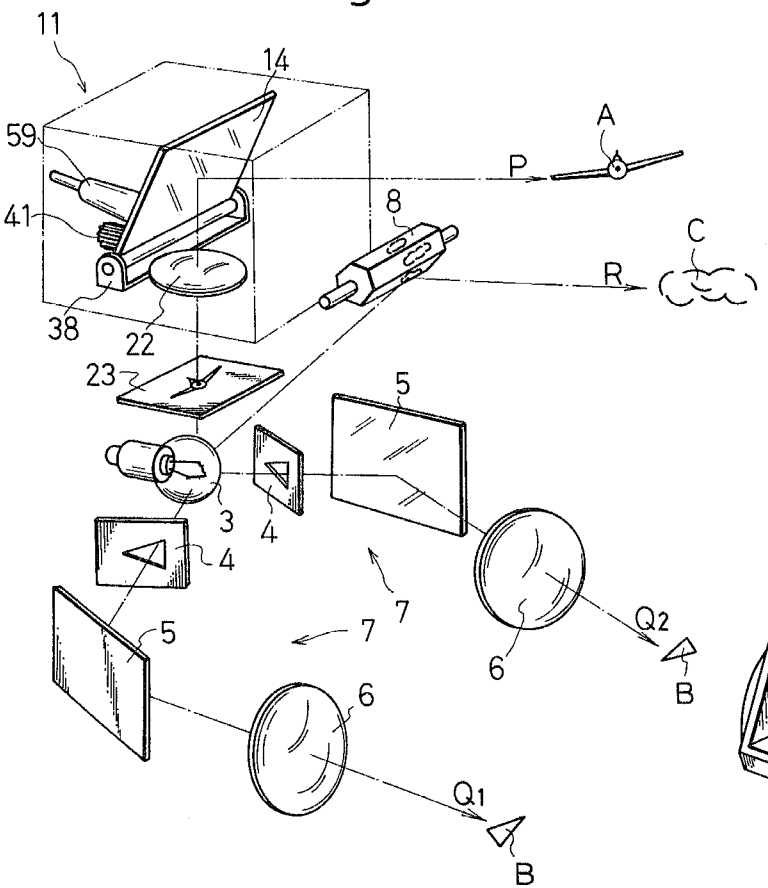
FIG. 2 shows an exploded view of a bullet projecting device and a target projecting device.

Referring to FIGS. 1 and 2, a projector-type shooting game apparatus 1 is facing a screen 2 wherein target beam P, bullet beam Q and back scene beam R are emitted from the apparatus 1 onto the screen 2 to project a target T such as an airplane, a bullet B such as a rocket bomb, and a hit sign H. Ta designates a regular orbit for the target T, and $Tb_1$ and $Tb_2$ designates the trace of the bullets B.

The shooting game apparatus 1 has, in a housing 10 having a longitudinal axis, a pair of bullet image forming units 7A and 7B comprising a light source 3, a slit 4 for bullets, a mirror 5 for bullets, and a lense 6 for bullets, a pair of symmetrical bullet projecting devices 7, a third image projecting means 8 (a rotatable polygonal cylindrical mirror) for providing third image beam R to project moving portion of the back scene, such as clouds C, and a target forming and controlling device 11. The housing 10 has a lever 12 extending therefrom. 9 designates a shooting button for firing bullet beam Q.

Now referring to FIGS. 3–6, the target forming and controlling device 11 comprises a driving means container 13 coupled to a plate 10*a* attached to the housing 10 as an integral unit, a mirror 14, a mirror controlling means in the horizontal direction 15 (i.e., about a vertical axis), and a mirror controlling means in the longitudinal direction 16 (i.e., about a horizontal axis), thereby allowing the mirror 14 to freely change its angle both about horizontal and vertical axes.

In the driving means container 13, there is provided a driving mechanism 21 comprising an electric motor 17, a decelerating mechanism 18, a horizontal driving mechanism 19, and a longitudinal driving mechanism 20.

In front of the driving means container 13, there are provided a target lense 22, a target forming means 23 (target slit plate), a shutter plate 24, where the target slit plate 23 is provided with a target mark 25 and a hit mark 26 by way of an opening or a transparent portion. The base of the target slit plate 23 and the shutter plate 24 are loosely coupled to shafts 27 and 28 respectively and held with a slip mechanism 30 comprising fasteners 29*a* and 29*b*, washers 31, and loaded springs 32, whereby the target slit plate 23 and the shutter plate 24 are rotatably connected to the shafts 27 and 28. Since the shaft 28 is decelerated by declerating mechanism 18 and therefore has less revolution than the shaft 27, the hit mark 26 takes the place of the target mark 25 between the lamp 3 and the mirror 14 due to rotation of the target slit plate 23, when the target is hit and a hit detecting mechanism 60 gives a signal to the electric motor 17 for reverse rotation. Thus, a hit mark H is projected on the screen 2 instead of the target mark T. After a moment, the shutter plate 24 will close the light and the hit mark H on the screen will disappear.

Figure 4:
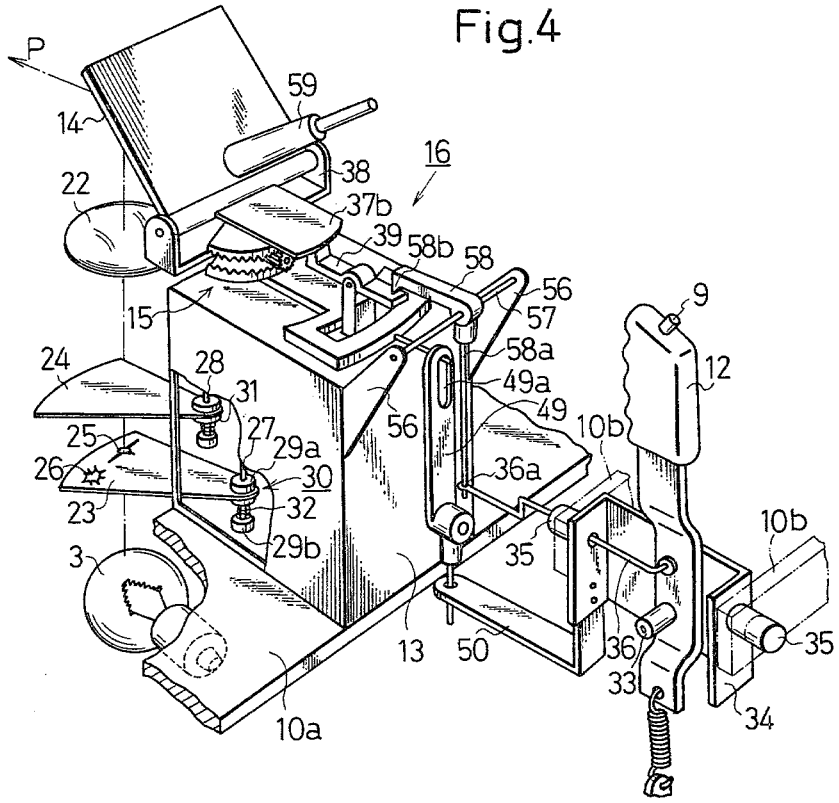
FIG. 4 shows a perspective view of a part of the projecting device in FIG. 3.
Figure 5:
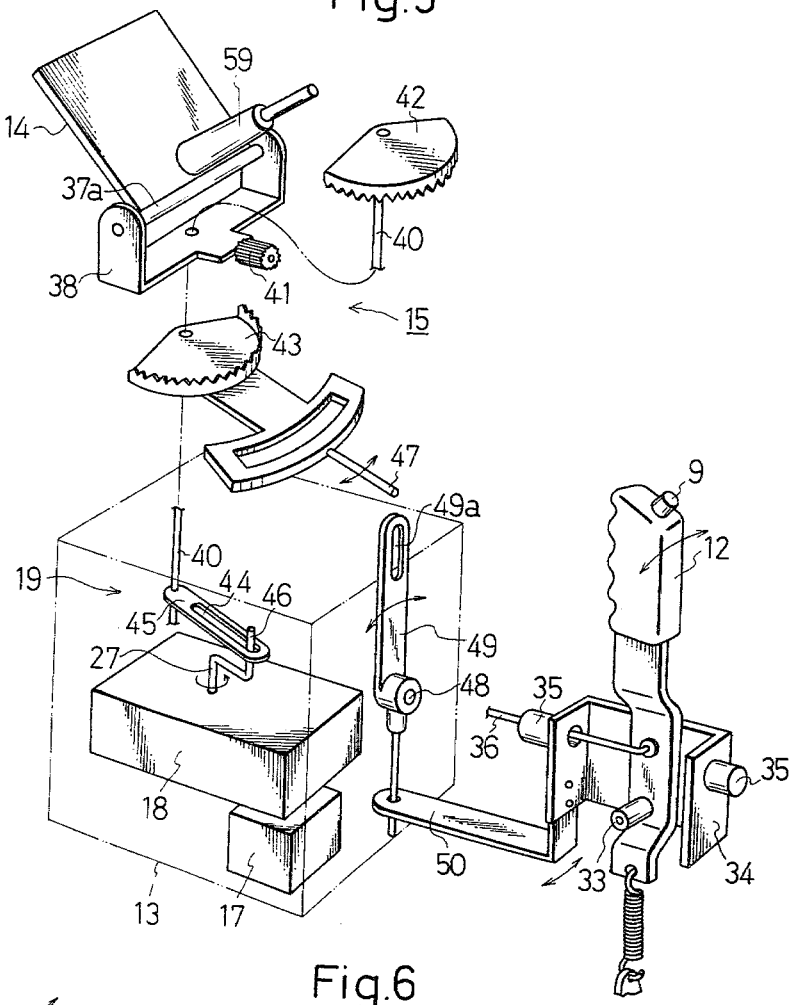
FIG. 5 shows an exploded view of a horizontal mirror rotating mechanism.

In FIGS. 4 and 5, the lever 12 is held by a shaft 35 fixed to a lever holding case 34 and supported by a supporting plate 10*b* coupled to the housing 10*a* an integral unit such that the lever is rotatable about a horizontal axis; further the lever 12 is held by a shaft 33 fixed to the case 34 as to be rotatable about a horizontal axis perpendicular to the axis of shaft 35.

Figure 3:
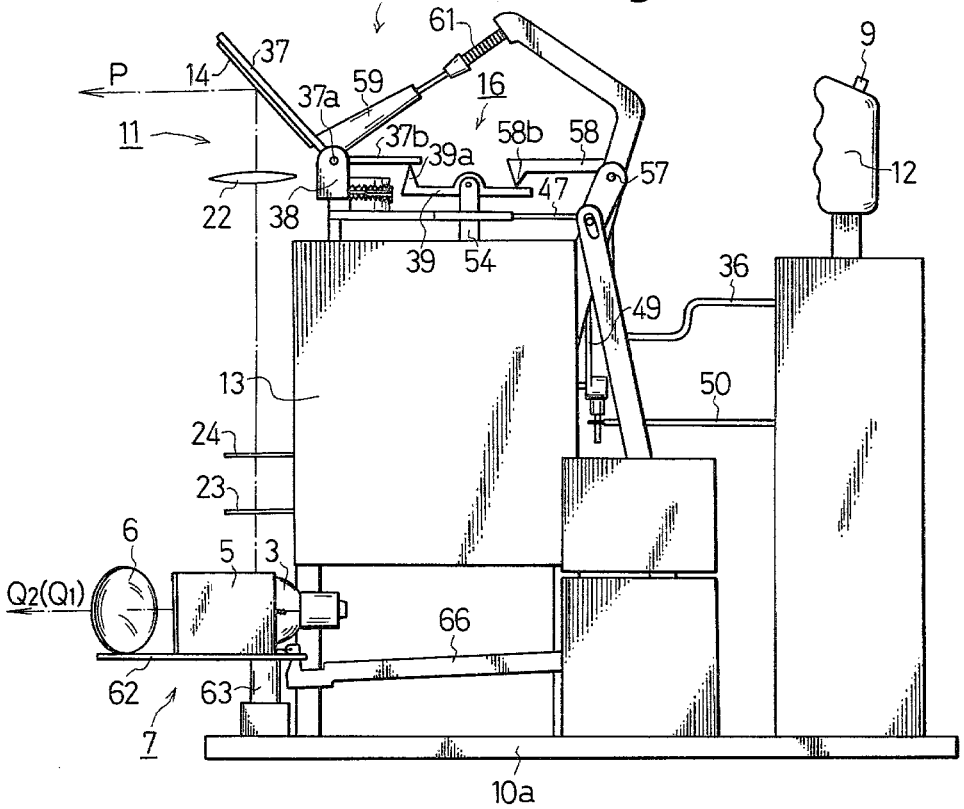
FIG. 3 shows a side elevational view of an image projecting device including a hit sensing means.

In FIG. 3, the mirror 14 is coupled to a mirror supporting base 37 connected to a shaft 37*a* which is rotatably held by a mirror stand 38 such that the mirror 14 is rotatable about a horizontal axis. The shaft 37*a* has an extension 37*b* which is kept in contact with a projection 39*a* of a joint bar 39*b* wherein the mirror 14 can be rotated by elevating the projection 39*a*, thereby constituting a horizontal axis mirror rotating means 16.

In FIG. 5, the mirror stand 38 is loosely held by a shaft 40 as to be rotatable about a vertical axis. The mirror stand 38 is provided with a pinion 41 which is sandwiched by a first sector type bevel gear 42 fixed to the upper part of the shaft 40 and a second sector-type bevel gear 43 rotatably applied to the shaft 40 in the horizontal direction, wherein the mirror 14 can be rotated about a vertical axis by rotating either the first or the second gear, thereby constituting a horizontal mirror rotating means 15.

As shown in FIG. 5, the shaft 40 is provided with an arm 45 with a long opening 44 at the bottom portion thereof, and a crank 46 formed at the top of a shaft in a decelerating mechanism 18, such as the shaft 27 is inserted into the long opening 44, whereby the bevel gear 42 can be rotated in the horizontal direction by rotating the shaft 27 causing rotation of the arm, whereby constituting a driving means 19 for moving the mirror 14 in the horizontal direction.

A transverse shaft 47 to rotate with the second sector bevel gear 43 is engaged with the long opening 49*a* wherein the rotation of the lever 12 is transferred to the bevel gear 43 through a longitudinal lever 49 pivotally held by the driving means container 13 and a transverse lever 50 fixed to the bottom portion of the lever holding case 34, whereby providing a means for connecting the lever 12 to the horizontal mirror rotating means 15.

Figure 6:
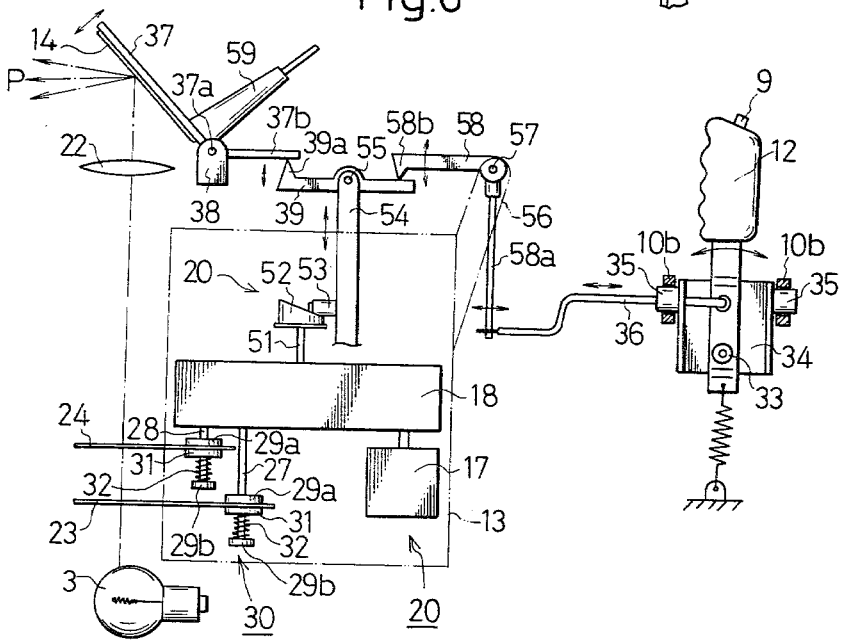
FIG. 6 shows an exploded view of a longitudinal mirror rotating mechanism.

Referring to FIG. 6, a cam 52 (a cylinder cut through diagonally to have an oval shape) is provided at the upper portion of a cam shaft 51 of the decelerating mechanism 18 and is kept in contact with a roller 53, and a stroke arm 54 to have a longitudinal movement according to the rotation of the cam shaft 51 and is engaged with a central portion of the joint bar 39 at the upper part thereof, whereby the projection 39*a* moves in the longitudinal direction due to the movement of the stroke arm 54 causing the mirror to rotate about a horizontal axis thereby constituting a horizontal axis mirror rotating means 20.

The driving means container 13 has a supporting bar 56 extending therefrom to which a push arm 58 is pivotally connected, wherein a projection 58*b* formed at the tip of the push arm 58 is kept in contact with the bottom portion of the joint bar 39. Further, a rod 58*a* extending downward from the push arm 58 is inserted into an opening 36*a* provided at the tip of the lever 36 to transform the back and forth movement of the lever 12 into the movement of the projection 58*b*, thereby constituting a means for connecting the horizontal rotation of the lever 12 about the axis of shaft 33 and the horizontal axis mirror rotating means 16.

Now referring back to FIG. 3, 59 designates a shooting point indicator extending from the rear of mirror 14, the shooting point indicator 59 is so set to face a sensor piece 61 when the mirror 14 comes to a position to project target beam from the light source 3 right at a shooting point V. Thus, upon making a hit, the indicator 59 comes to contact and pushes the sensor piece 61 causing the motor 17 to switch to reverse revolution, whereby constituting a hit sensor means 60.

Figure 7:
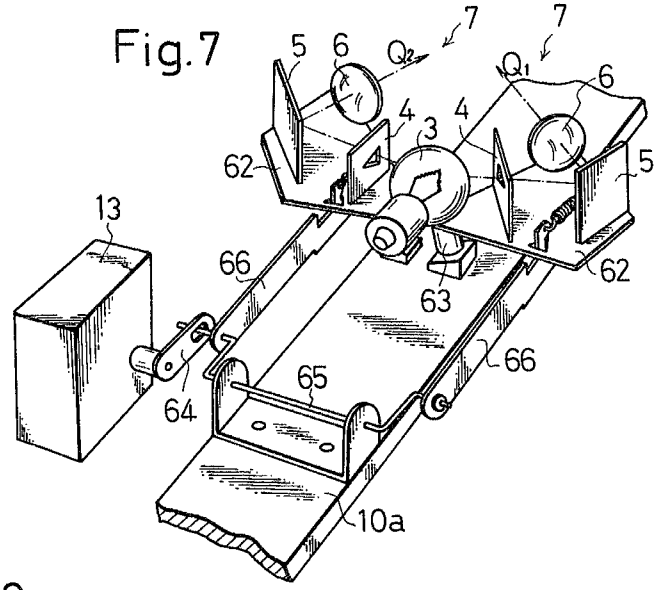
FIG. 7 shows a perspective view of a bullet projecting device.

In FIG. 7, the bullet projecting device 7 has a supporting plate 62 with the bullet slit 4, the bullet mirror 5 and the bullet lense 6 attached thereto, such that the plate 62 is pivotally held by a shaft fixed to the plate 10*a* to be rotatably around the light source 3. The supporting plate 62 receives force from the motor 17 and the decelerating mechanism 18 through the driving arm 64, the crank 65 and the crank arm 66, whereby the supporting plate 62 rotates around the supporting shaft 63 upon one cycle of the motion of the crank 65. The light beam Q1 and Q2 are emitted from the light source 3 through the slit 4, reflected with the mirror 5 and cast on the screen 2 through the lense 6 to draw tracks Tb1 and Tb2 toward the center of the screen 2.

Figure 10:
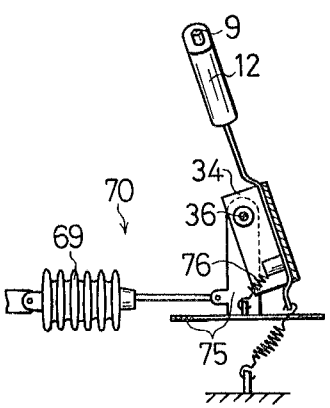
FIG. 10 shows a side elevational view of a mechanism for late motion in the horizontal direction.
Figure 9:
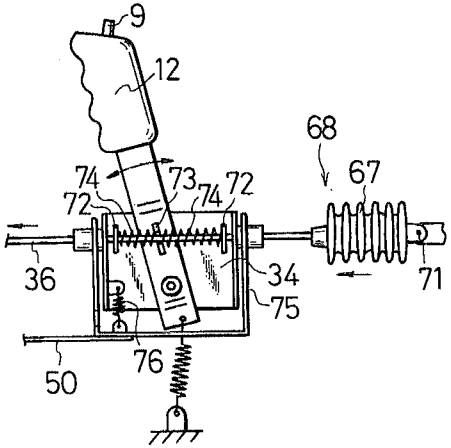
FIG. 9 shows a side elevational view of a mechanism for late motion in the vertical direction.
Figure 8:
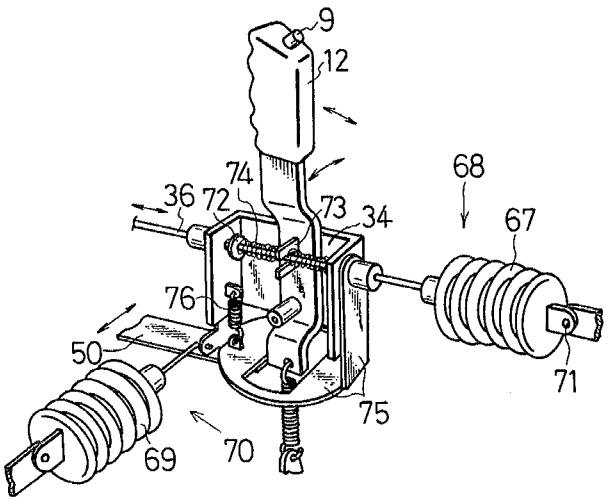
FIG. 8 shows a perspective view of a part of a time differential connecting mechanism.

Referring to FIG. 8, there is provided an air damper 67 in connection with the vertical motion of a connecting lever 36 and the lever 12 to form a first time differential connecting means 68; and there is provided another air damper 69 in connection with the horizontal motion of the connecting lever 36 and the lever 12 to form a second time differential connecting means 70. The first time differential connecting means 68 works as follows. Since the connecting lever 36 has its end fixed to the housing 10 through the air damper 67 with a pin 71, a press spring 74 inserted between a fastener 72 fixed to the connecting lever 36 and a projection 73 on the lever 12 is pressed by pulling the lever 12 suddenly causing the air damper 67 to expand and take air in as shown in FIG. 9. As a result, the connecting lever 36 moves gradually. In FIGS. 8 and 10, there is shown the function of the second time differential connecting means 70. A transverse connecting lever 50 is connected to a subframe 75 instead of a supporting frame 34 and the air damper 69 is disposed between the subframe 75 and housing 10. Upon pulling the lever 12 suddenly leftward, the subframe 75 is blocked by the air damper 69 causing a pull spring 76 attached to the supporting frame 34 to be pulled. Thus, the air damper 69 expands and takes air in by the spring load. This will cause the subframe 75 move gradually toward the supporting frame 34.

In addition to the air dampers 67 and 69, it is equally possible to use an air fan as in a music box, oil damper, and the like.

Hereinbelow there is given an explanation on a hit sensing device 60. Referring to FIGS. 3 and 11 through 16, the hit sensing device 60 comprises an effective hit spot indicator 59 extending from the back of the mirror 14, a sensing piece 61 arranged to come into contact with the indicator 59 when the mirror is so set to reflect the target beam from the light source 3 onto a hit spot V, and a switch operating arm 77 of an electric switch 80 to switch the motor 17 for reverse motion.

Figure 11:
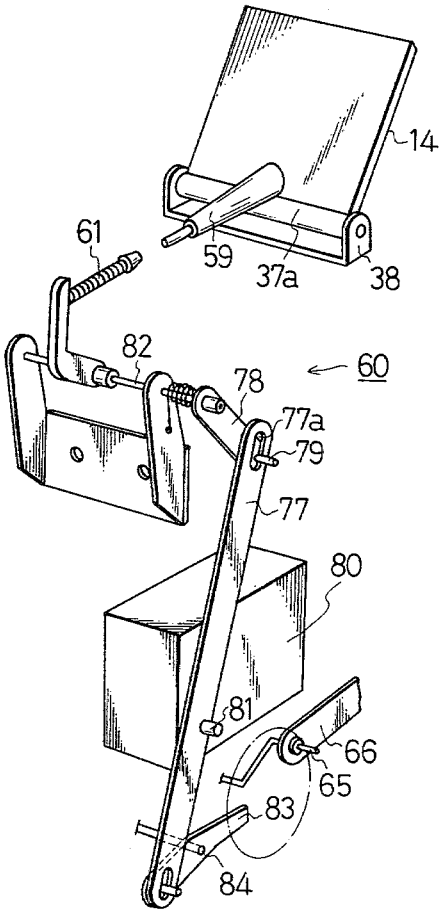
FIG. 11 shows a perspective view of a first embodiment of a hit sensing device of this invention.
Figure 12:
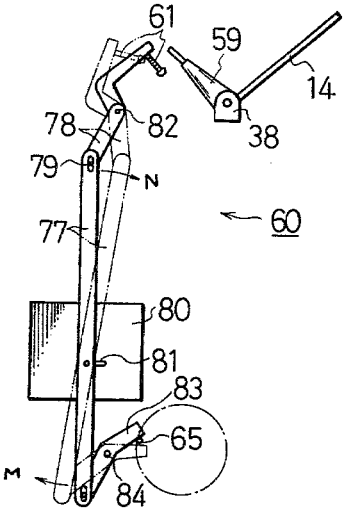
FIG. 12 shows a side elevational view of the embodiment shown in FIG. 11 at a non-hit state.

There is shown a first embodiment in FIGS. 10 through 12, where a switch lever 81 of the switch 80 is inserted into an opening provided in the switch operating arm 77 which makes a motion cycle every time a bullet is fired. A pin 79 is inserted into a long opening 77*a* provided in the upper tip of the arm 77, said pin being a tip of the connecting lever which rotates with the sensing piece 61. A supporting shaft 82 connected with the sensing piece 61 as an integral unit is held by the housing 10 through a stand and the shaft 82 holds the upper portion of the connecting lever 78 in a pivotal manner. 83 designates an arm for connecting the crank 65 (see FIG. 7) to the switch operating arm 77, and a supporting shaft 84 pivotally holding the arm 83 is fixedly supported by a supporting plate (not shown) which is an integral part of the housing.

Upon each shooting (or one cycle of the crank 65), the arm 77 is to rotate along the arrow M; however, if the target is not at the hit spot V or in non-hit state, it will move along the arrow N, since the sensing piece does not face the indicator 59. Accordingly, as shown in FIG. 12, the arm 77 rotates around the switch lever 81 along the arrows M and N not moving the switch lever 81 thereby causing no action on the switch 80.

Figure 13:
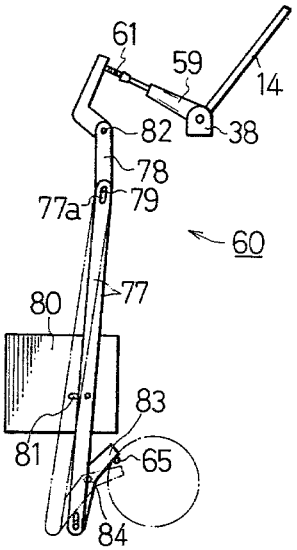
FIG. 13 shows a side elevational view of the embodiment shown in FIG. 11 at a hit state.

Upon shooting when the target A is at the hit spot V, the sensing piece 61 comes to contact with the indicator 59, the connecting lever 78 having the sensing piece 61 will stop further rotation. Accordingly, as shown in FIG. 13, the pin 79 works as a fixed shaft to get the arm 77 rotate around the pin 79 and get the switch lever 81 turn the switch on for reverse motion.

Figure 14:
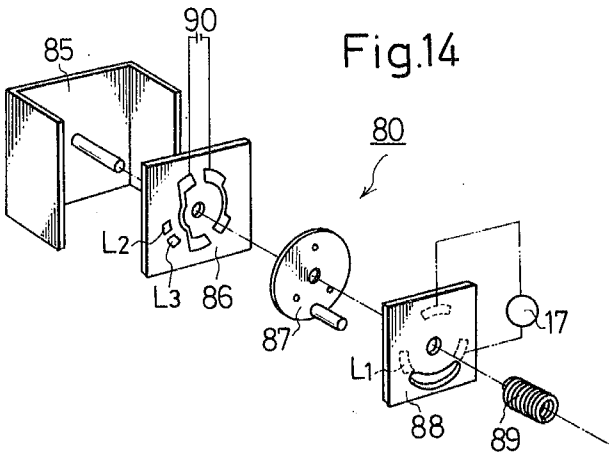
FIG. 14 shows an exploded view of an embodiment of an electric switch for reverse motion.

FIG. 14 shows an exploded view of an embodiment of the switch 80 for reverse motion, where a switch frame 85 is equipped with a first contact plate 86, a movable disc 87, a second contact plate 88 and a press spring 89. The movable disc 87 is rotated by moving the switch lever 81 causing friction between the first contact plate 86 and the second contact plate 88. Thus, the connection between the power source 90 and the motor 17 can be changed. The movable disc 87 is formed of non-conductive matiral with an opening therethrough allowing a conductive item to be inserted and is fastened with eyelets. Since the contact point with the contact L1 is switched form L2 to L3, upon rotation of the lever 81, the switch 80 may be used as a trigger of an electronic circuit to generate electronic sound connected to the hit mark H.

In the above embodiment, the switch mechanism shown in FIG. 14 is fixed to the housing 10 and a rotor as used in a watch movement is used for counting the number of hits, said rotor being rotated by the switch lever 81. The rotor also counts the number of rotation of the crank 65 or the bottom tip of the arm 77 to determine the number of shootings.

Figure 15:
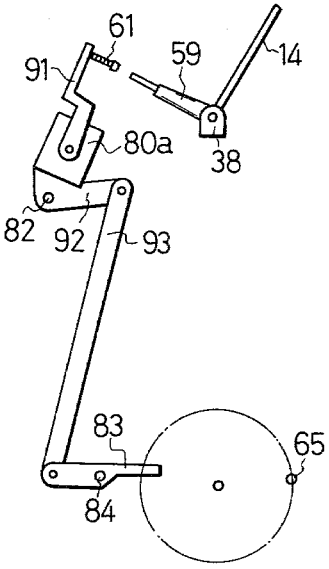
FIG. 15 shows a side elevational view of a second embodiment of a hit sensing device of this invention at a non-hit state.
Figure 16:
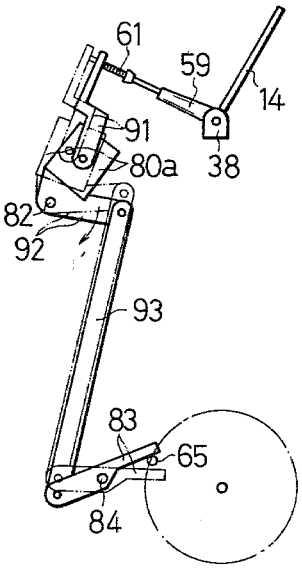
FIG. 16 shows a side elevational view of the second embodiment of a non-hit state.

Referring to FIGS. 15 and 16, there is shown a second embodiment where the counting mechanism can be omitted. A micro switch 8*a*, which can be turned for reverse action, is firmly coupled to an upper surface of the base of the switch operating arm 77 pivotally supported with the fixed supporting shaft. The sensing piece 61 is extending from the tip of an operating lever 91 of the micro switch 80*a*. An operating arm 92 and the arm 83 are connected by a connecting lever 93, such that the arm 74 rotates along the arrow M upon every one rotation of the crank 65, whereby the lever 91 rotates to turn the switch on for reverse motion with the sensing piece 72 upon coming into contact with the indicator 71, only when a bullet hits the target.

Once the motor 17 is switched on to have a regular revolution, the target mark 25 of the target slit plate 23 is positioned at the top of the light source 3 so that target beam P is released to reach the screen 2 through the target lense 22 and the mirror 14 to project the target (airplane) A. As shown in FIG. 6, rotation of the cam shaft 51 causes longitudinal motion of the stroke arm 54 through the cam 52 and the roller 53, and the joint bar 39 moves up and down around the projection 58*b* causing the extension 37*b* to move up and down through the projection 39*a*. Thus, the mirror 14 rotates back and forth due to the horizontal mirror rotating means 15 and the horizontal mirror driving mechanism 19 to move the target A on the screen along the direction. At the same time, as shown in FIG. 5, rotation of the shaft 27 causes rotation of the pinion 41 through the crank 46, the arm 45, the shaft 40, the second bevel gear 43, and when the second bevel gear 43 is fixed, the first bevel gear 42 rotates back and forth up to a half of its maximum rotating angle around the shaft 40. Thus, the target A is moved on the screen along the X direction due to the longitudinal mirror rotating means 16 and the longitudinal mirror driving mechanism 20. As a result, the target A will have a track Ta similar to "8" on the screen 2.

The track Ta will vary with its configuration and starting point based upon the position of the crank 46 and the cam 27 at the time the motor 17 switches on for regular revolution. In the case of air fighting, a player may be instructed to adjust the lever 12 to place the target at a suggested point in the center of the screen 2 before he starts shooting in order that he is in a position to follow the target airplane A. By rotating the lever back and forth about the axis of shaft 33, the projection 58*b* moves up and down causing the joint bar 39 around the shaft 55 to result in motion of the projection 39*a*. When the projection 58*b* has motion commensurate in speed and direction with the existing motion of the projection 39*a* by the stroke arm 54, the mirror 14 stops its rotation about the axis of shaft 37*a*. As shown in FIG. 5, by rotating the lever about the axis of shaft 35, the mirror stand 38 will rotate about the axis of shaft 40 due to the rotation of the second bevel gear 43. When the second bevel gear 43 is rotated at a rate equal and opposite to the existing rotation of the first bevel gear 42, the mirror 14 will stop its rotation about the axis of shaft 40.

Accordingly, the rotation of the lever 12 and the motion of the target A have the following relation, which is similar to the action of a lever of a real airplane.

| Lever | Motion (direction) of Target |
|---|---|
| pull | down |
| push | up |
| right | left |
| left | right |

By adjusting the lever to get the target to draw, the "8" track on the screen 2, the player can place the target at the shooting point in the center of the screen 2.

When the target A is placed at the shooting point and the player pushes the button 9, the bullet B is projected on the screen 2 by the bullet projecting devices 7A and 7B. Upon hitting the target A, the motor 17 gets into reverse revolution causing the shafts 27 and 28 to reverse rotation upon receiving a signal from the sensing means 60. Due to the reverse rotation of the shaft 28, the target slit plate 23 will come to a "shut" position and a hit image H will be projected on the screen 2. Further, due to the reverse rotation of the shaft 27, the shutter plate 24 moves to a "shut" position to shut the target beam and cut the hut image H. Since the shaft 28 of the shutter plate 24 has a slower rotation speed than the shaft 27 of the target slit plate 23, the slit plate 23 rotates at first to change the target A to the hit image H, and then after a moment, the hit image H will disappear just as a real fight.

When there are provided the first and second time differential connecting means 68 and 70, the target does not change its track quickly upon rotating the lever 12, but the target will change its track gradually giving a feeling of a real operation of an airplane.

The primary feature of this invention is that the target as projected on a screen will have a complex motion because of a player's manual operation in addition to the mechanical control, which requires high technique to hit the target and provides an interesting challenge to a player.

The second feature of this invention is that the motion of the lever is communicated to the mirror driving means through time differential connecting means such that the target will respond to the operation of the lever with some delay thereby providing a feeling of a real operation of an airplane.

The third feature of this invention is that there are provided an effective hit spot indicator, a sensing piece to come into contact with the indicator upon hitting, and a switch for reversing the motor, whereby a hit can be sensed very precisely and clearly with a simple mechanism.

I claim:

1. A projector-type shooting game apparatus comprising:

a screen;

a housing having a longitudinal axis and for projecting a target image onto said screen;

a mirror rotatably coupled to said housing such that said mirror is rotatable in first and second axes mutually perpendicular to each other and both of said first and second axes being perpendicular to said longitudinal axis;

a means for changing an angle of said mirror about said first axis;

a means for changing an angle of said mirror about said second axis;

a driving means for driving both said angle changing means;

a lever manually movable about third and fourth axes;

a means for mechanically coupling said lever's movement to both said means for changing the angle of said mirror, whereby the motion of said mirror is effected by said driving means and by a player's manual operation of said lever.

2. A hit sensing device for use in a projector-type shooting apparatus of the type including a screen, a mirror movable about first and second axes which are mutually perpendicular to each other to project a target image onto said screen, a driving means for moving said mirror about said first and second axes, and a bullet image projecting means, said hit sensing device comprising:

an effective hit spot indicator extending from the back of said mirror;

a sensing piece facing said indicator and moved in a longitudinal direction by a driving means of said bullet image projecting means, an end of said sensing piece being positioned to face an end of said indicator when the angles of said mirror about both said first and second axes are in a position to project a target image on the screen at an effective hit spot; and an electric switch turned on when said indicator and said sensing piece come into contact when said target image is projected onto said screen at said effective hit spot and said sensing piece is moved ahead by operation of said driving means of said bullet image projecting means during shooting operations.

3. A projector-type shooting game apparatus comprising:

a screen;

a housing to project a target image onto said screen, said housing having a longitudinal axis;

a mirror rotatable about mutually perpendicular first and second axes which are both perpendicular to said longitudinal axis in said housing;

a means for changing an angle of said mirror about said first axis;

a means for changing an angle of said mirror about said second axis;

a driving means for driving both said angle changing means;

a lever manually movable about third and fourth axes;

a means for mechanically coupling said lever's movement to said means for changing the angles of said mirror whereby the motion of the mirror is effected by said driving means and by a player's manual operation of said lever; and a hit sensing device comprising:

an effective hit spot indicator extending from the back of said mirror;

a sensing piece facing said indicator, the end of said sensing piece being positioned to face an end of said indicator when the angles of said mirror about said first and second axes are in a position to project a target image onto said screen at an effective hit spot;

a means for pushing said sensing piece to move toward said indicator during shooting operation so that the end of said sensing piece contacts the end of said indicator when said mirror is in said position; and an electric switch turned on when said indicator and said sensing piece contact when said target image is projected onto said screen at said effective hit spot and said sensing piece is moved ahead during shooting operation.

4. A projector-type shooting game apparatus according to claim 1 or 3 wherein there is provided a first time differential connecting means between said lever and said means for changing the angle of said mirror about said first axis, and also provided a second time differential connecting means between said lever and said means for changing the angle of said mirror about said second axis.

5. A hit sensing device for use in a projector-type shooting game apparatus of the type including a screen, a mirror movable about two mutually perpendicular first and second axes to project a target image onto said screen, a driving means for moving said mirror about said first and second axes and a bullet image projecting means, said hit sensing device comprising:

an effective hit spot indicator extending from the back of said mirror;

a sensing piece facing said indicator, the end of said sensing piece being positioned to face an end of said indicator when the angles of said mirror are in a position to project a target image onto said screen at an effective hit spot;

an electric switch having a switch lever; and a switch operating arm driven by a crank shaft of said driving means of said bullet image projecting means, said switch operating arm moving said sensing piece in a longitudinal direction so that the end of said sensing piece is contacted with the end of said indicator when said target image is projected onto said screen at an effective hit spot and said switch lever is operated to switch on said switch.

* * * * *